US009884227B2

(12) United States Patent
Berggren et al.

(10) Patent No.: US 9,884,227 B2
(45) Date of Patent: Feb. 6, 2018

(54) SPORT BALLS AND METHODS OF MANUFACTURING THE SPORT BALLS

(71) Applicant: NIKE, Inc., Beaverton, OR (US)

(72) Inventors: Scott R. Berggren, Portland, OR (US); Scott W. Johnson, Beaverton, OR (US); Vincent F. White, Beaverton, OR (US)

(73) Assignee: NIKE, Inc., Beaverton, OR (US)

( * ) Notice: Subject to any disclaimer, the term of this patent is extended or adjusted under 35 U.S.C. 154(b) by 206 days.

(21) Appl. No.: 14/589,466

(22) Filed: Jan. 5, 2015

(65) Prior Publication Data

US 2015/0182812 A1 Jul. 2, 2015

Related U.S. Application Data

(62) Division of application No. 13/434,891, filed on Mar. 30, 2012, now Pat. No. 8,926,459.

(51) Int. Cl.
*A63B 45/00* (2006.01)
*A63B 41/02* (2006.01)
(Continued)

(52) U.S. Cl.
CPC ..... *A63B 45/00* (2013.01); *A63B 41/00* (2013.01); *A63B 41/02* (2013.01); *A63B 41/085* (2013.01);
(Continued)

(58) Field of Classification Search
CPC ..... A63B 41/00; A63B 41/02; A63B 41/085; A63B 45/00; A63B 2243/0025; Y10T 29/49714; Y19T 29/49826
See application file for complete search history.

(56) References Cited

U.S. PATENT DOCUMENTS 414,748 A 11/1889 Bentley
1,517,859 A 12/1924 O'Shea
(Continued)

FOREIGN PATENT DOCUMENTS

CN 1741834 A 3/2006
CN 101218002 A 7/2008
(Continued)

OTHER PUBLICATIONS

International Search Report and Written Opinion mailed Jun. 10, 2011 for PCT/US2010/058904.
(Continued)

*Primary Examiner* — Steven Wong
(74) *Attorney, Agent, or Firm* — Quinn IP Law

(57) ABSTRACT

A sport ball may include a casing that forms an exterior surface of the sport ball. The casing may incorporate a plurality of joined panels, including a closure panel. In addition, the ball may include a backing layer located radially inward of the closure panel, the backing layer extending beyond a peripheral boundary of the closure panel and at least partially overlapping with one or more panels adjacent to the closure panel. The backing layer may also include an opening located radially inward of the closure panel, the opening being smaller than the surface area of the closure panel. Also, the ball may include a bladder located radially inward of the backing layer, the bladder including a valve for introducing fluid into the ball, the valve extending through the opening and through the closure panel.

20 Claims, 21 Drawing Sheets

(51) Int. Cl.
*A63B 41/08* (2006.01)
*A63B 41/00* (2006.01)

(52) U.S. Cl.
CPC . *A63B 2243/0025* (2013.01); *Y10T 29/49714* (2015.01); *Y10T 29/49826* (2015.01)

(56) References Cited

U.S. PATENT DOCUMENTS

| | | | | |
|---|---|---|---|---|
| 1,575,281 | A | 3/1926 | Rosenberg | |
| 1,853,008 | A | 4/1932 | Turner | |
| 1,917,535 | A | 7/1933 | Maynard | |
| 1,923,890 | A | 8/1933 | Scudder | |
| 1,932,226 | A | 10/1933 | Pierce | |
| 1,967,908 | A | 7/1934 | Sneary | |
| 2,011,562 | A | 8/1935 | Crowley | |
| 2,012,376 | A | 8/1935 | Caro | |
| 2,018,559 | A | 10/1935 | Horner | |
| 2,073,766 | A | 3/1937 | Suzuki | |
| 2,080,894 | A | 5/1937 | Levinson | |
| 2,116,479 | A | 5/1938 | Reach | |
| 2,126,220 | A | 8/1938 | Scudder | |
| 2,211,669 | A | 8/1940 | Reach | |
| 2,300,441 | A | 11/1942 | Voit et al. | |
| 2,325,073 | A | 7/1943 | Reach | |
| 2,344,638 | A | 3/1944 | Reeder | |
| 2,945,693 | A | 7/1960 | Way | |
| 3,512,777 | A | 5/1970 | Henderson | |
| 4,154,789 | A | 5/1979 | Delacoste | |
| 4,239,568 | A * | 12/1980 | Takazawa | B29D 22/04 156/155 |
| 4,320,776 | A | 3/1982 | Yang | |
| 4,436,276 | A | 3/1984 | Donahue | |
| 4,513,058 | A | 4/1985 | Martin | |
| 4,610,071 | A | 9/1986 | Miller | |
| 4,856,781 | A | 8/1989 | Shishido et al. | |
| D322,105 | S | 12/1991 | Ma | |
| 5,123,659 | A | 6/1992 | Williams | |
| 5,181,717 | A | 1/1993 | Donntag et al. | |
| 5,250,070 | A | 10/1993 | Parodi | |
| 5,494,625 | A | 2/1996 | Hu | |
| 5,503,699 | A | 4/1996 | Ratner et al. | |
| 5,603,497 | A | 2/1997 | Louez | |
| 5,752,890 | A | 5/1998 | Shishido et al. | |
| 5,772,545 | A | 6/1998 | Ou | |
| 5,779,578 | A | 7/1998 | Calandro | |
| 5,888,157 | A | 3/1999 | Guenther et al. | |
| 6,012,997 | A | 1/2000 | Mason | |
| 6,142,897 | A | 11/2000 | Lees | |
| 6,261,400 | B1 | 7/2001 | Kennedy, III | |
| 6,302,815 | B1 | 10/2001 | Shishido et al. | |
| 6,331,151 | B2 | 12/2001 | Calandro | |
| 6,461,461 | B2 | 10/2002 | Kennedy, III | |
| 6,503,162 | B1 | 1/2003 | Shishido et al. | |
| 6,629,902 | B2 | 10/2003 | Murphy et al. | |
| 6,645,099 | B2 | 11/2003 | Gaff et al. | |
| 6,685,585 | B2 | 2/2004 | Shishido et al. | |
| 6,726,582 | B1 | 4/2004 | Kuo et al. | |
| 6,971,965 | B1 | 12/2005 | Shishido | |
| 6,991,569 | B2 | 1/2006 | Dobrounig | |
| 7,005,025 | B2 | 2/2006 | Summers | |
| 7,018,311 | B2 | 3/2006 | Ou | |
| 7,029,407 | B2 | 4/2006 | Lee et al. | |
| 7,066,853 | B2 | 6/2006 | Chang | |
| 7,427,246 | B2 | 9/2008 | Taniguchi et al. | |
| 7,517,294 | B2 | 4/2009 | Tsai | |
| 7,645,203 | B2 | 1/2010 | Tang et al. | |
| 7,749,116 | B2 | 7/2010 | Tang et al. | |
| 7,753,813 | B2 | 7/2010 | Taniguchi et al. | |
| 8,192,311 | B2 | 6/2012 | White et al. | |
| 8,210,973 | B2 | 7/2012 | Rapaport et al. | |
| 8,540,595 | B1 | 9/2013 | Lin | |
| 8,926,459 | B2 | 1/2015 | Berggren et al. | |
| 2001/0002378 | A1 | 5/2001 | Calandro | |
| 2002/0086749 | A1 | 7/2002 | Ou | |
| 2003/0203780 | A1 | 10/2003 | Guenther et al. | |
| 2004/0077288 | A1 | 4/2004 | Krysiak et al. | |
| 2004/0144477 | A1 | 7/2004 | Taniguchi et al. | |
| 2004/0229722 | A1 | 11/2004 | Liu | |
| 2005/0081982 | A1 | 4/2005 | Chen | |
| 2005/0229985 | A1 | 10/2005 | Saxenfelt | |
| 2006/0063622 | A1 | 3/2006 | Nurnberg et al. | |
| 2006/0229149 | A1 | 10/2006 | Goedoen | |
| 2006/0293132 | A1 | 12/2006 | Laliberty et al. | |
| 2007/0049434 | A1 | 3/2007 | Maziarz et al. | |
| 2007/0225094 | A1 | 9/2007 | Nix | |
| 2009/0105019 | A1 | 4/2009 | Keppler et al. | |
| 2009/0325747 | A1 | 12/2009 | Ou | |
| 2011/0183791 | A1 | 7/2011 | Lo | |
| 2013/0053193 | A1 | 2/2013 | Lo | |
| 2013/0260928 | A1 | 10/2013 | Berggren et al. | |

FOREIGN PATENT DOCUMENTS

| | | | |
|---|---|---|---|
| CN | 104203355 | A | 12/2014 |
| EP | 0 598 542 | A2 | 5/1994 |
| FR | 2 572 674 | A1 | 5/1986 |
| JP | 10-337341 | A | 12/1998 |
| WO | 01/83047 | A1 | 11/2001 |
| WO | 2004/056424 | A1 | 7/2004 |
| WO | 2009/158103 | A1 | 12/2009 |
| WO | 2011/084289 | A1 | 7/2011 |
| WO | 2013/148950 | A1 | 10/2013 |

OTHER PUBLICATIONS

International Preliminary Report on Patentability (including Written Opinion of the ISA) mailed Jul. 19, 2012 in International Application No. PCT/US2010/058904.
International Search Report and Written Opinion mailed Jul. 31, 2013 for PCT/US2013/034280.
International Preliminary Report on Patentability (including Written Opinion of the ISA) mailed Oct. 9, 2014 in International Application No. PCT/US2013/034280.
Office Action mailed Jan. 13, 2014 in U.S. Appl. No. 13/434,891.
Interview Summary mailed Apr. 2, 2014 in U.S. Appl. No. 13/434,891.
Response filed Apr. 14, 2014 in U.S. Appl. No. 13/434,891.
Final Office Action mailed May 23, 2014 in U.S. Appl. No. 13/434,891.
Interview Summary mailed Aug. 25, 2014 in U.S. Appl. No. 13/434,891.
Response filed Aug. 25, 2014 in U.S. Appl. No. 13/434,891.
Notice of Allowance mailed Sep. 3, 2014 in U.S. Appl. No. 13/434,891.
Interview Summary mailed Oct. 27, 2014 in U.S. Appl. No. 13/434,891.
Supplemental Notice of Allowability mailed Oct. 29, 2014 in U.S. Appl. No. 13/434,891.
Voluntary Amendments filed Apr. 1, 2015 in Chinese Patent Application No. 201380017464.7.
Voluntary Amendments filed May 12, 2015 in European Patent Application No. 13724034.7.

* cited by examiner

SPORT BALLS AND METHODS OF MANUFACTURING THE SPORT BALLS

CROSS-REFERENCE TO RELATED APPLICATION

This application is a divisional of Berggren et al., U.S. Patent Application Publication No. 2013/0260928, published on Oct. 3, 2013, the entire disclosure of which is incorporated herein by reference.

BACKGROUND

A variety of inflatable sport balls, such as a soccer ball, conventionally exhibit a layered structure that includes a casing, an intermediate layer, and a bladder. The casing forms an exterior portion of the sport ball and is generally formed from a plurality of durable and wear-resistant panels joined together along abutting edges (e.g., with stitching or adhesives). Although panel configurations may vary significantly, the casing of a traditional soccer ball includes thirty-two panels, twelve of which have a pentagonal shape and twenty of which have a hexagonal shape.

The intermediate layer forms a middle portion of the sport ball and is positioned between the casing and the bladder. Among other purposes, the intermediate layer may provide a softened feel to the sport ball, impart energy return, and restrict expansion of the bladder. In some configurations, the intermediate layer or portions of the intermediate layer may be bonded, joined, or otherwise incorporated into the casing as a backing material.

The bladder, which has an inflatable configuration, is located within the intermediate layer to provide an interior portion of the sport ball. In order to facilitate inflation (i.e., with pressurized air), the bladder generally includes a valved opening that extends through each of the intermediate layer and casing, thereby being accessible from an exterior of the sport ball.

In order to facilitate joining of the panels that make up the casing, the casings of many balls are assembled inside-out, thus providing access to flanges at the edges of the panels that typically project inward and are sewn, glued, or welded to flanges of adjacent panels. Once assembly of the inside-out casing is nearly complete, the casing is turned right-side-out, and the final unclosed portions of the casing are joined to complete closure of the casing. For example, in some cases, one or two seams of a casing are left unclosed, providing an opening for the casing to be turned right-side-out through. Once the casing is turned right-side-out, a bladder, restriction layer, and/or other layers may be inserted through the opening before the last seams are joined, providing the final closure of the casing.

SUMMARY

In one aspect, the present disclosure is directed to a sport ball. The ball may include a casing that forms an exterior surface of the sport ball. The casing may incorporate a plurality of joined panels, including a closure panel. In addition, the ball may include a backing layer located radially inward of the closure panel, the backing layer extending beyond a peripheral boundary of the closure panel and at least partially overlapping with one or more panels adjacent to the closure panel. The backing layer may also include an opening located radially inward of the closure panel, the opening being smaller than the surface area of the closure panel. Also, the ball may include a bladder located radially inward of the backing layer, the bladder including a valve for introducing fluid into the ball, the valve extending through the opening and through the closure panel.

In another aspect, the present disclosure is directed to a sport ball. The ball may include a casing having an inner surface and an outer surface, the outer surface forming an exterior surface of the sport ball. The casing may incorporate a plurality of joined panels, including a closure panel. In addition, the ball may include a backing layer located radially inward of the closure panel, the backing layer extending beyond a peripheral boundary of the closure panel and at least partially overlapping with one or more panels adjacent to the closure panel. The backing layer may include an opening located radially inward of the closure panel, the opening being smaller than the surface area of the closure panel. Also, the backing layer may line the entire inner surface of the casing except for the area where the opening in the backing layer is located.

In another aspect, the present disclosure is directed to a method of making a sport ball. The method may include forming a partially assembled casing by joining a plurality of panels, leaving open one area configured to receive a closure panel, wherein the partially assembled casing is formed inside-out. In addition, the method may include placing a backing layer over at least a portion of the inside-out, partially assembled casing. Further, the method may include locating an opening in the backing layer over the open area of the partially assembled casing configured to receive a closure panel, the opening in the backing layer being smaller than the open area of the partially assembled casing. The method may also include turning the partially assembled casing and backing layer right-side-out through the opening in the backing layer and the open area of the partially assembled backing layer, and installing a closure panel in the open area against the backing layer.

In another aspect, the present disclosure is directed to a method of making a sport ball. The method may include forming a partially assembled casing by joining a plurality of panels, the partially assembled casing including an open area. The method may also include securing a backing layer to an interior surface of the partially assembled casing, the backing layer including an opening located within the open area. In addition, the method may include positioning a bladder within the partially assembled casing through the opening of the backing layer. Further, the method may include locating a closure panel in the open area, and securing the closure panel to the backing layer.

The advantages and features of novelty characterizing aspects of the invention are pointed out with particularity in the appended claims. To gain an improved understanding of the advantages and features of novelty, however, reference may be made to the following descriptive matter and accompanying figures that describe and illustrate various configurations and concepts related to the invention.

FIGURE DESCRIPTIONS

The foregoing Summary and the following Detailed Description will be better understood when read in conjunction with the accompanying figures.

DETAILED DESCRIPTION

The following discussion and accompanying figures disclose various sport ball configurations and methods relating to manufacturing of the sport balls. Although the sport ball is discussed and depicted in relation to a soccer ball, concepts associated with the configurations and methods may be applied to various types of inflatable sport balls. In addition to soccer balls, therefore, concepts discussed herein may be incorporated into basketballs, footballs (for either American football or rugby), volleyballs, and water polo balls, for example. A variety of non-inflatable sport balls, such as baseballs and softballs, may also incorporate concepts discussed herein.

General Sport Ball Configuration

Figure 1:
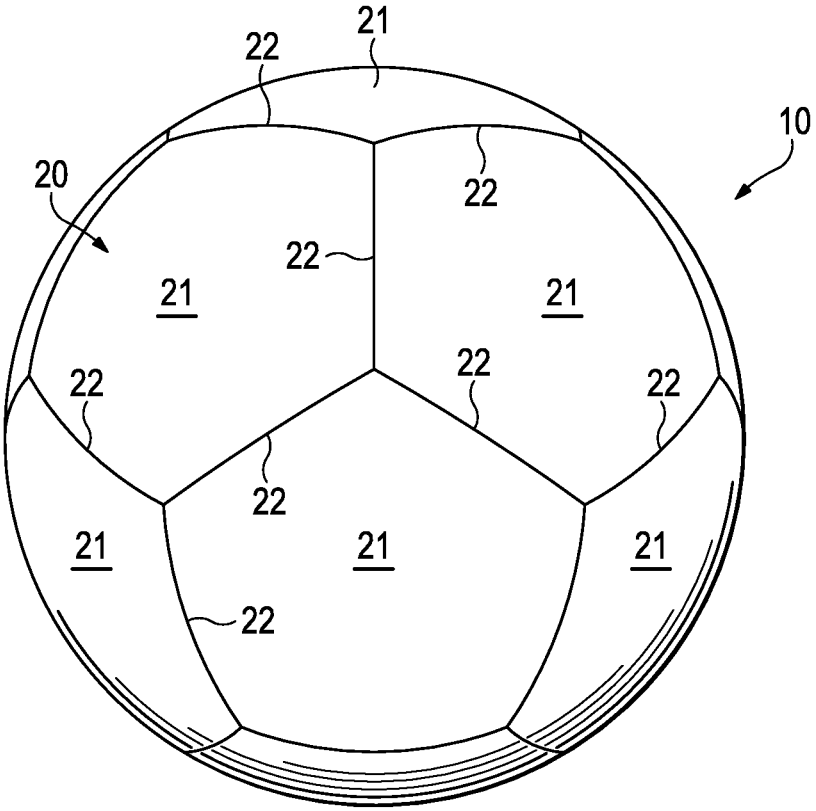
FIG. 1 is a perspective view of a sport ball.
Figure 2:
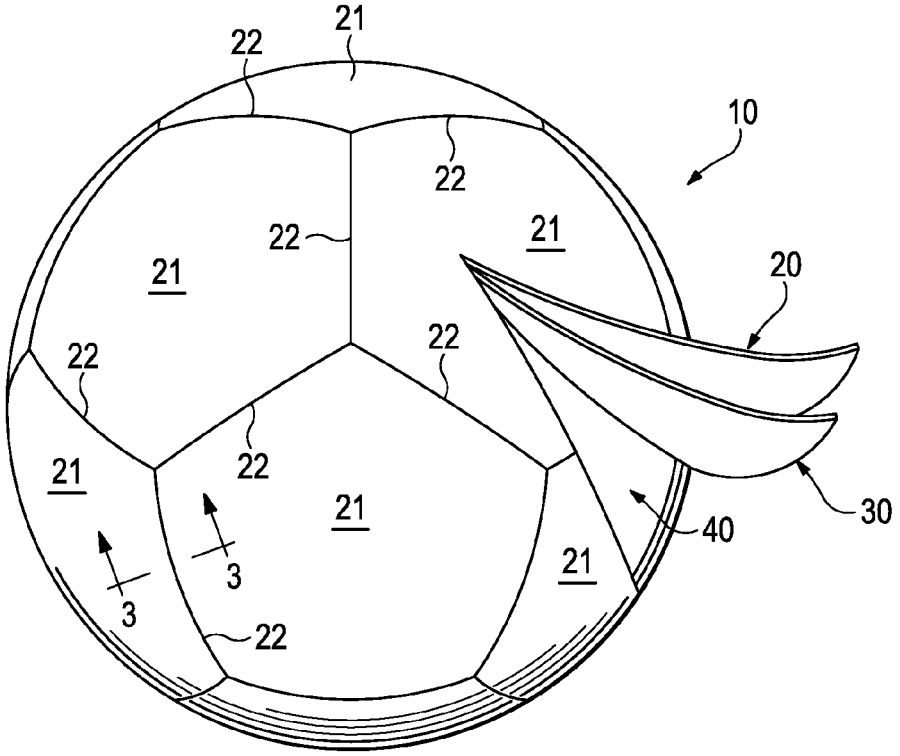
FIG. 2 is another perspective view of the sport ball.
Figure 3:
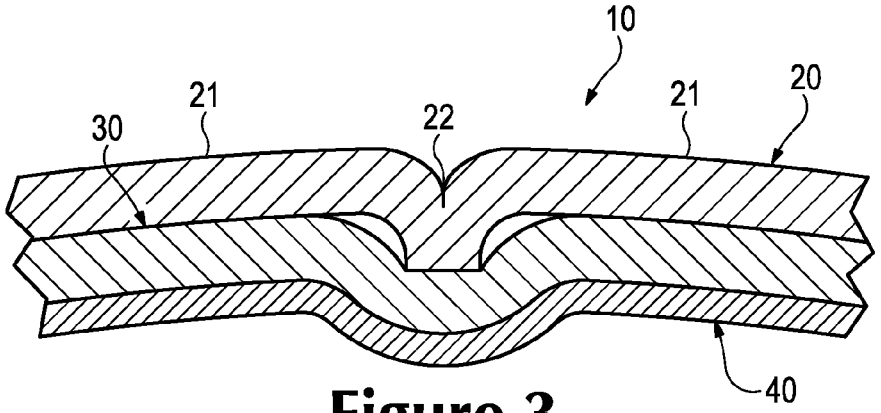
FIG. 3 is a cross-sectional view of a portion of the sport ball, as defined by section line 3-3 in FIG. 2.

A sport ball 10 having the general configuration of a soccer ball is depicted in FIGS. 1-3. Sport ball 10 exhibits a layered structure having (a) a casing 20 that forms an exterior portion of sport ball 10, (b) an intermediate layer 30 located within casing 20, and (c) an inflatable bladder 40 that forms an interior portion of sport ball 10. Upon pressurization, bladder 40 induces sport ball 10 to take on a substantially spherical shape. More particularly, pressure within bladder 40 causes bladder 40 to place an outward force upon intermediate layer 30. In turn, intermediate layer 30 places an outward force upon casing 20. In order to limit expansion of bladder 40 and also limit tension in casing 20, a portion of intermediate layer 30 may have a limited degree of stretch. In other words, bladder 40 places an outward force upon intermediate layer 30, but the stretch characteristics of intermediate layer 30 effectively prevent the outward force from inducing significant tension in casing 20. Accordingly, intermediate layer 30 restrains pressure from bladder 40, while permitting outward forces to induce a spherical shape in casing 20, thereby imparting a spherical shape to sport ball 10.

Casing 20 is formed from various panels 21 that are joined together along abutting sides or edges to form a plurality of seams 22. Although panels 21 are depicted as having the shapes of twelve equilateral pentagons, panels 21 may have non-equilateral shapes, concave or convex edges, or a variety of other shapes (e.g., triangular, square, rectangular, hexagonal, trapezoidal, round, oval, non-geometrical) that combine in a tessellation-type manner to form casing 20. In some configurations, sport ball 10 may have twelve pentagonal panels 21 and twenty hexagonal panels 21 to impart the general configuration of a traditional soccer ball. Selected panels 21 may also be formed of unitary (i.e., one piece) construction with adjacent panels 21 to form bridged panels that reduce the number of seams 22. Accordingly, the configuration of casing 20 may vary significantly.

Panels 21 may be joined to form seams 22 in any suitable manner. For example, in some configurations, panels 21 may be joined with stitching (e.g., hand or machine stitching), in a conventional or alternative manner. In some configurations, a welding process may be utilized in the manufacture of sport ball 10 to join panels 21 and form seams 22. More particularly, panels 21 may be at least partially formed from a polymer material, which may be a thermoplastic polymer material, and edges of panels 21 may be heated and bonded to each other to form seams 22. An example of the configuration of seams 22 is depicted in the cross-section of FIG. 3, wherein the welding process has effectively secured, bonded, or otherwise joined two of panels 21 to each other by combining or intermingling the polymer material from each of panels 21. In other configurations, some of panels 21 may be joined through stitching, or various seams 22 may be supplemented with stitching.

One advantage of utilizing a welding process to form seams 22 relates to the overall mass of sport ball 10. Whereas approximately ten to fifteen percent of the mass of a conventional sport ball may be from the seams between panels, welding panels 21 may reduce the mass at seams 22. By eliminating stitched seams in casing 20, the mass that would otherwise be imparted by the stitched seams may be utilized for other structural elements that enhance the performance properties (e.g., energy return, sphericity, mass distribution, durability, aerodynamics) of sport ball 10. Another advantage relates to manufacturing efficiency. Stitching each of the seams of a conventional sport ball is a relatively time-consuming process, particularly when hand stitching is utilized. By welding panels 21 together at seams 22, the time necessary for forming casing 20 may be deceased, thereby increasing the overall manufacturing efficiency.

Intermediate layer 30 is positioned between casing 20 and bladder 40 and may be formed to include one or more of a compressible foam layer that provides a softened feel to the sport ball, a rubber layer that imparts energy return, and a restriction layer to restrict expansion of bladder 40. The overall structure of intermediate layer 30 may vary significantly. As an example, the restriction layer may be formed from (a) a thread, yarn, or filament that is repeatedly wound around bladder 40 in various directions to form a mesh that covers substantially all of bladder 40, (b) a plurality of generally flat or planar textile elements stitched together to form a structure that extends around bladder 40, or (c) a plurality of generally flat or planar textile strips that are impregnated with latex and placed in an overlapping configuration around bladder 40 The restriction layer may also be a substantially seamless spherically-shaped textile, as disclosed in Raynak et al., U.S. Patent Application Publication No. 2009/0325746, published Dec. 31, 2009. In some configurations of sport ball 10, intermediate layer 30 or portions of intermediate layer 30 may also be bonded, joined, or otherwise incorporated into casing 20 as a backing material, or intermediate layer 30 may be absent from sport ball 10. Accordingly, the structure of intermediate layer 30 may vary significantly to include a variety of configurations and materials.

Bladder 40 has an inflatable configuration and is located within intermediate layer 30 to provide an inner portion of sport ball 10. When inflated, bladder 40 exhibits a rounded or generally spherical shape. In order to facilitate inflation, bladder 40 may include a valved opening (not depicted) that extends through intermediate layer 30 and casing 20, thereby being accessible from an exterior of sport ball 10, or bladder 40 may have a valveless structure that is semi-permanently inflated. Bladder 40 may be formed from a rubber or carbon latex material that substantially prevents air or other fluids within bladder 40 from diffusing to the exterior of sport ball 10. In addition to rubber and carbon latex, a variety of other elastomeric or otherwise stretchable materials may be utilized for bladder 40. In some configurations, bladder 40 may also have a structure formed from a plurality of joined panels, as disclosed in Rapaport et al., U.S. Patent Application Publication No. 2009/0325745 published Dec. 31, 2019.

Manufacturing Process

Figure 4:
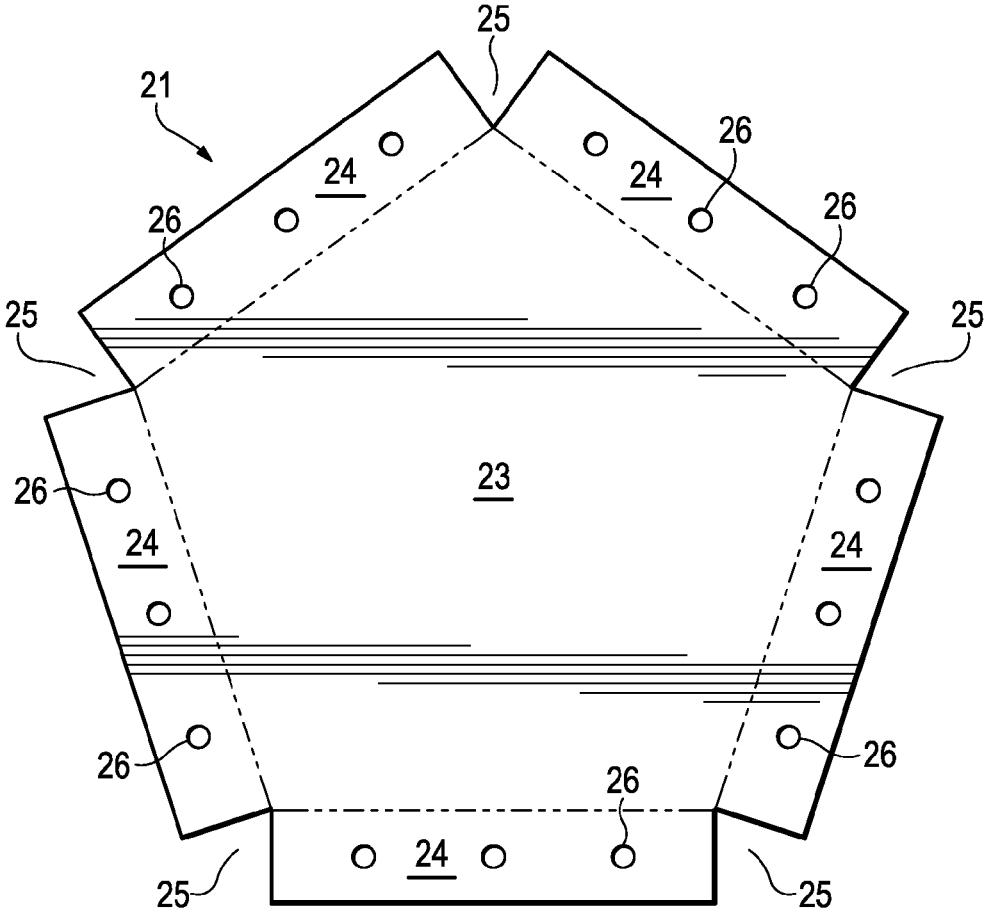
FIG. 4 is a top plan view of a panel of the sport ball.

The panels of conventional sport balls, as discussed above, may be joined with stitching (e.g., hand or machine stitching). Panels 21 are, however, at least partially formed from a polymer material, which may be a thermoplastic polymer material, that can be joined through the welding process. Referring to FIG. 4, one of panels 21 prior to incorporation into sport ball 10 is depicted as having a panel area 23 and five flange areas 24. Whereas panel area 23 generally forms a central portion of panel 21, flange areas 24 generally form edge portions of panel 21 and extend around panel area 23. For purposes of reference, dashed lines are depicted as extending between panel area 23 and the various flange areas 24. Panel 21 has a pentagonal shape and each of flange areas 24 correspond with one side region of the pentagonal shape. In further configurations where a panel has a different shape, the number of flange areas may change to correspond with the number of sides of the shape. Panel 21 defines five notches 25 that extend inward from vertices of the pentagonal shape and effectively separate the various flange areas 24 from each other. Notches 25 may, therefore, permit flange areas 24 to flex or otherwise move independent of each other, although flange areas 24 remain connected to panel area 23. Additionally, each flange area 24 defines various registration apertures 26 that form holes extending through panel 21.

Figures 5, 6:
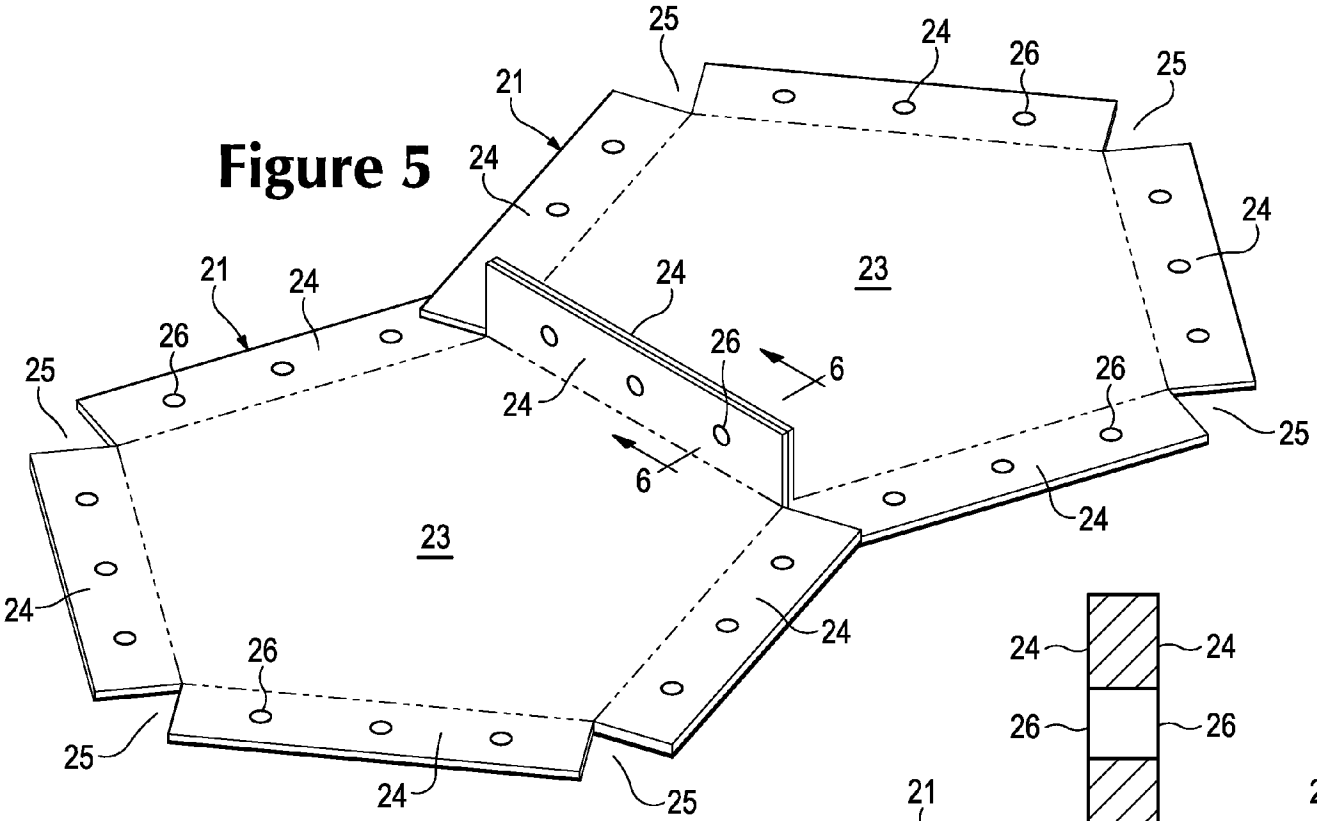
FIG. 5 is a perspective view of two joined panels.
FIG. 6 is a cross-sectional view of the joined panels, as defined by section line 6-6 in FIG. 5.

Panel areas 23 of the various panels 21 form a majority, or all of, the portion of casing 20 that is visible on the exterior of sport ball 10. Flange areas 24, however, form portions of panels 21 that are bonded together to join panels 21 to each other. Referring to FIGS. 5 and 6, an example of the manner in which two panels 21 are joined to each other is depicted. Although panel areas 23 are generally co-planar with each other, the joined flange areas 24 bend upward and are joined along abutting surfaces. Additionally, registration apertures 26 from each of the joined flange areas 24 are aligned. By aligning registration apertures 26 prior to bonding (i.e., through welding), flange areas 24 are properly positioned relative to each other. As discussed in greater detail below, portions of the joined flange areas 24 may be trimmed during the manufacturing process for casing 20. Note that the upwardly-facing surfaces in FIGS. 5 and 6 are located on an interior of sport ball 10 once manufacturing is completed, and downwardly-facing surfaces form an exterior surface of sport ball 10.

Panels 21 are discussed above as including a polymer material, which may be utilized to secure panels 21 to each other. Examples of suitable polymer materials for panels 21 include thermoplastic and/or thermoset polyurethane, polyamide, polyester, polypropylene, and polyolefin. In some configurations, panels 21 may incorporate filaments or fibers that reinforce or strengthen casing 20. In further configurations, panels 21 may have a layered structure that includes an outer layer of the polymer material and an inner layer formed from a textile, polymer foam, or other material that is bonded with the polymer material. Panels 21 may also incorporate multiple joined layers formed from a variety of materials.

When exposed to sufficient heat, the polymer materials within panels 21 transition from a solid state to either a softened state or a liquid state, particularly when a thermoplastic polymer material is utilized. When sufficiently cooled, the polymer materials then transition back from the softened state or the liquid state to the solid state. Based upon these properties of polymer materials, welding processes may be utilized to form a weld that joins portions of panels 21 (i.e., flange areas 24) to each other. As utilized herein, the term "welding" or variants thereof is defined as a securing technique between two elements that involves a softening or melting of a polymer material within at least one of the elements such that the materials of the elements are secured to each other when cooled. Similarly, the term "weld" or variants thereof is defined as the bond, link, or structure that joins two elements through a process that involves a softening or melting of a polymer material within at least one of the elements such that the materials of the elements are secured to each other when cooled. As examples, welding may involve (a) the melting or softening of two panels 21 that include polymer materials such that the polymer materials from each panel 21 intermingle with each other (e.g., diffuse across a boundary layer between the polymer materials) and are secured together when cooled and (b) the melting or softening a polymer material in a first panel 21 such that the polymer material extends into or infiltrates the structure of a second panel 21 (e.g., infiltrates crevices or cavities formed in the second panel 21 or extends around or bonds with filaments or fibers in the second panel 21) to secure the panels 21 together when cooled. Welding may occur when only one panel 21 includes a polymer material or when both panels 21 include polymer materials. Additionally, welding does not generally involve the use of stitching or adhesives, but involves directly bonding panels 21 to each other with heat. In some situations, however, stitching or adhesives may be utilized to supplement the weld or the joining of panels 21 through welding.

Figure 7:
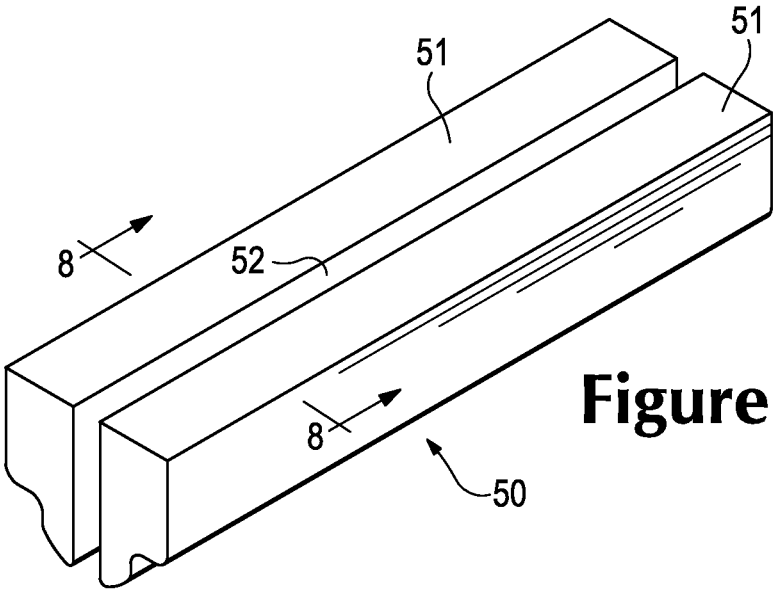
FIG. 7 is a perspective view of a welding tool utilized in joining the panels.
Figure 8:
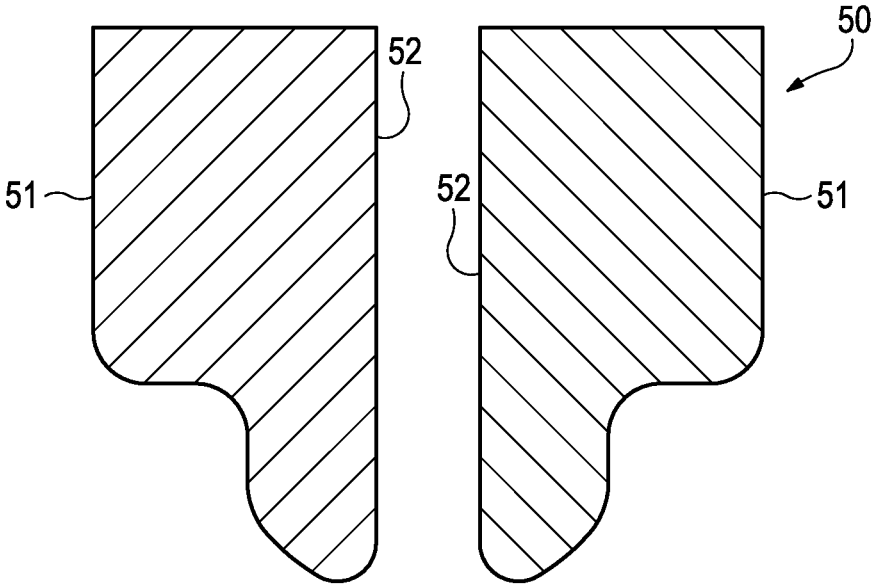
FIG. 8 is a cross-sectional view of the welding tool, as defined by section line 8-8 in FIG. 7.

A variety of techniques may be utilized to weld flange areas 24 to each other, including conduction heating, radiant heating, radio frequency heating, ultrasonic heating, and laser heating. An example of a welding die 50 that may be utilized to form seams 22 by bonding two flange areas 24 is depicted in FIGS. 7 and 8. Welding die 50 includes two portions 51 that generally correspond in length with a length of one of the sides of panels 21. That is, the length of welding die 50 is generally as long as or longer than the lengths of flange areas 24. Each portion 51 also defines a facing surface 52 that faces the other portion 51. That is, facing surfaces 52 face each other. If utilized for purposes of conduction heating, for example, portions 51 may each include internal heating elements or conduits that channel a heated liquid in order to sufficiently raise the temperature of welding die 50 to form a weld between flange areas 24. If utilized for purposes of radio frequency heating, one or both of portions 51 may emit radio frequency energy that heats the particular polymer material within panels 21. In addition to welding die 50, a variety of other apparatuses that may effectively form a weld between panels 21 may be utilized.

Figure 9A:
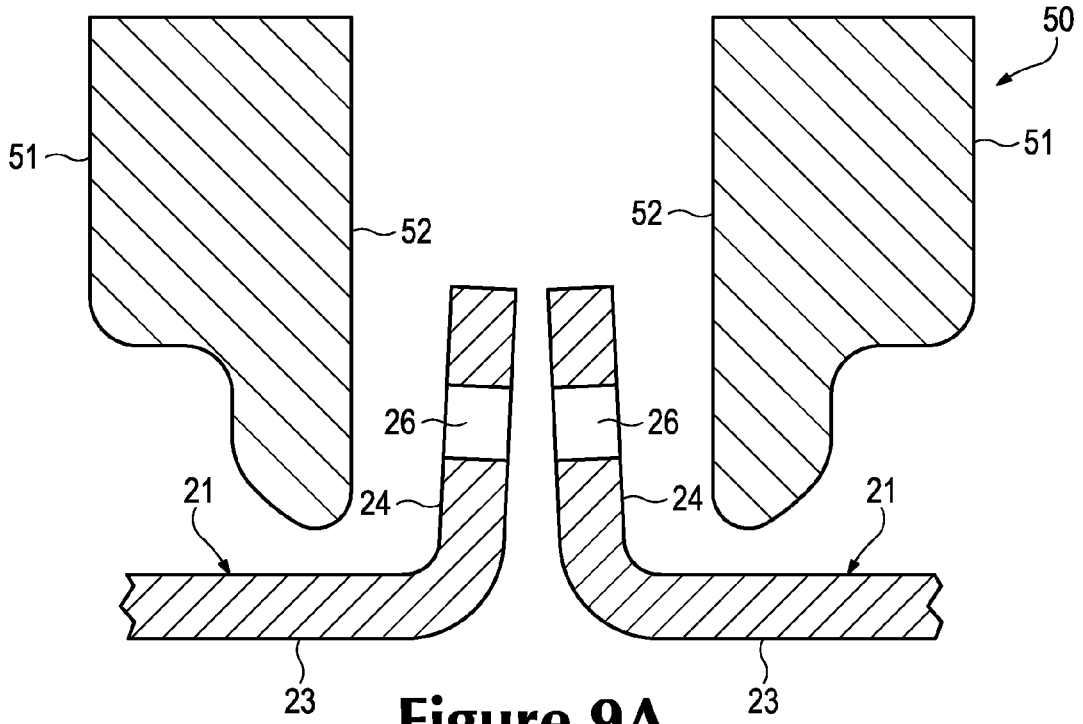
FIGS. 9A-9E are schematic cross-sectional views depicting steps of welding the panels together in a manufacturing process for the sport ball.
Figure 9B:
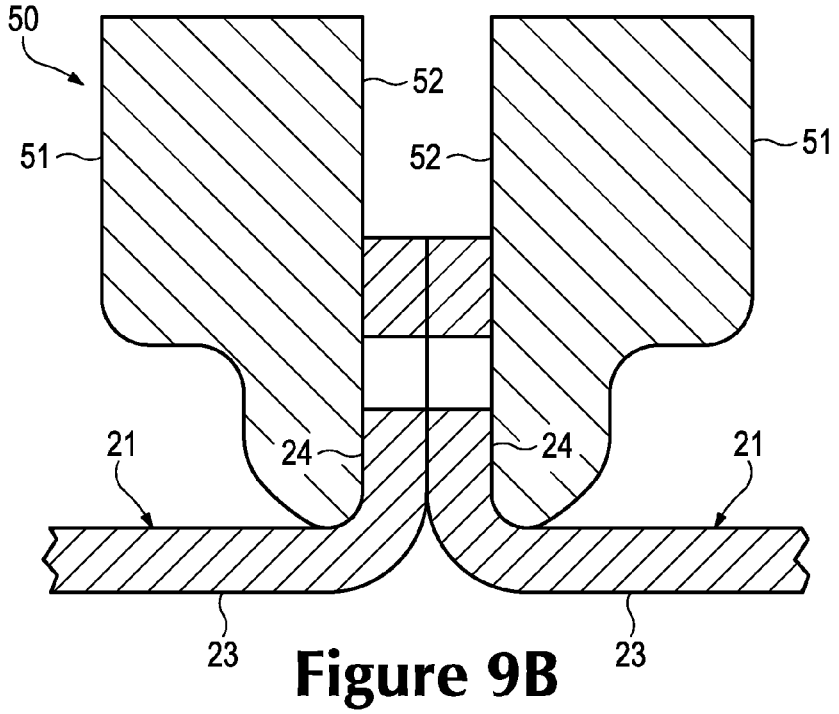
Figure 9C:
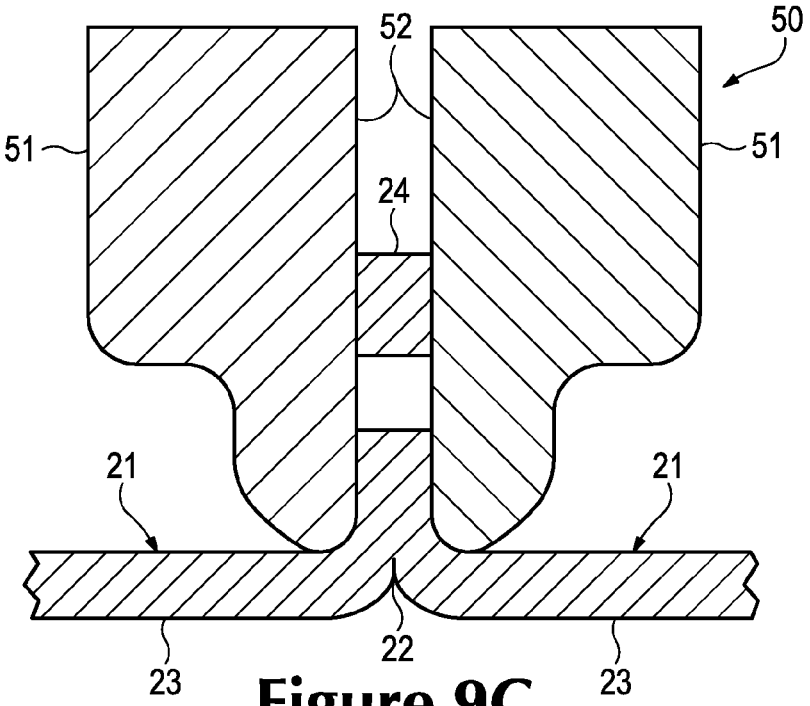
Figure 9D:
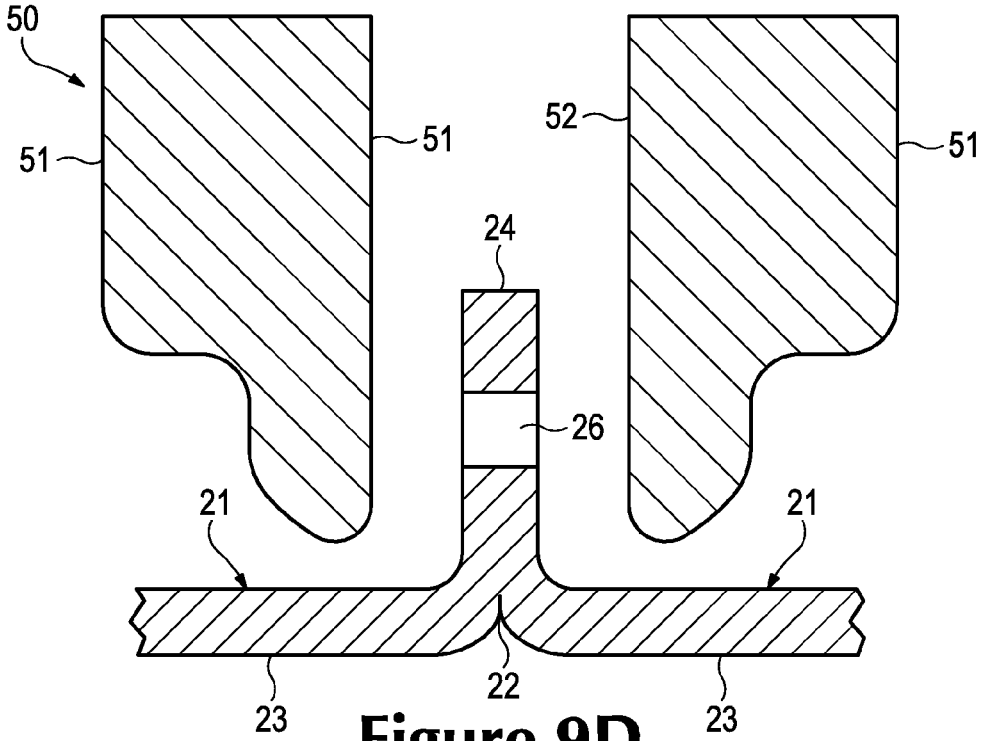
Figure 9E:
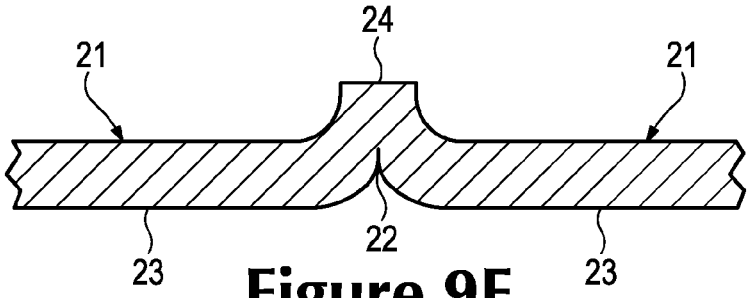

A general process for joining panels 21 with welding die 50 will now be discussed with reference to FIGS. 9A-9E. Initially, adjacent flange areas 24 from two panels 21 are located such that (a) surfaces of the flange areas 24 face each other and (b) registration apertures 26 are generally aligned, as depicted in FIG. 9A. Portions 51 of welding die 50 are also located on opposite sides of the abutting flange areas 24. Portions 51 then compress flange areas 24 together between facing surfaces 52 to cause surfaces of flange areas 24 to contact each other, as depicted in FIG. 9B. By heating flange areas 24 with welding die 50, the polymer materials within flange areas 24 melt or otherwise soften to a degree that facilitates welding between flange areas 24, as depicted in FIG. 9C, thereby forming seam 22 between panels 21. Once seam 22 is formed by bonding flange areas 24 together, portions 51 may retract from flange areas 24, as depicted in FIG. 9D. Excess portions of flange areas 24, which may include portions that define registration apertures 26, are then trimmed or otherwise removed to complete the formation of one of seams 22, as depicted in FIG. 9E.

Figure 10:
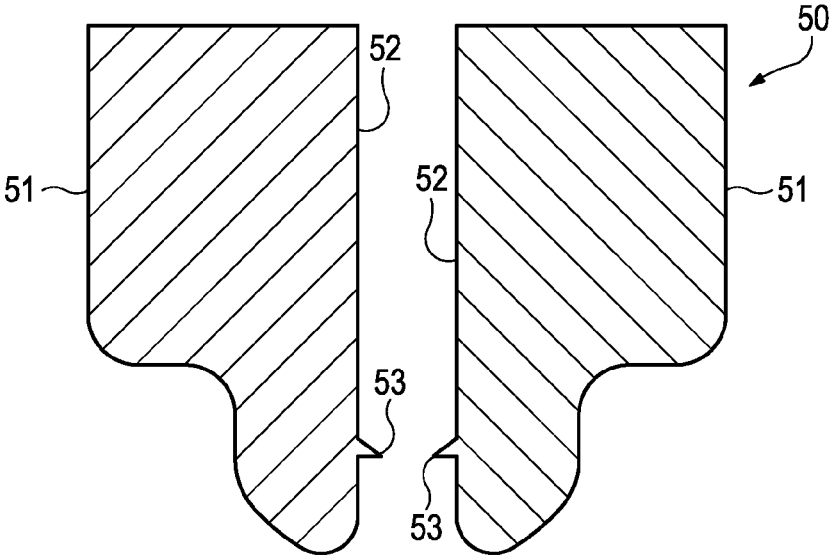
FIG. 10 is a cross-sectional view that corresponds with FIG. 8 and depicts another configuration of the welding tool.

A variety of trimming processes may be utilized to remove the excess portions of flange areas 24. As examples, the trimming processes may include the use of a cutting apparatus, a grinding wheel, or an etching process. As another example, welding die 50 may incorporate cutting edges 53, as depicted in FIG. 10, that trim flange areas 24 during the welding process. That is, cutting edges 53 may be utilized to protrude through flange areas 24 and effectively trim flange areas 24 as portions 51 heat and compress flange areas 24 together between facing surfaces 52.

Figure 11A:
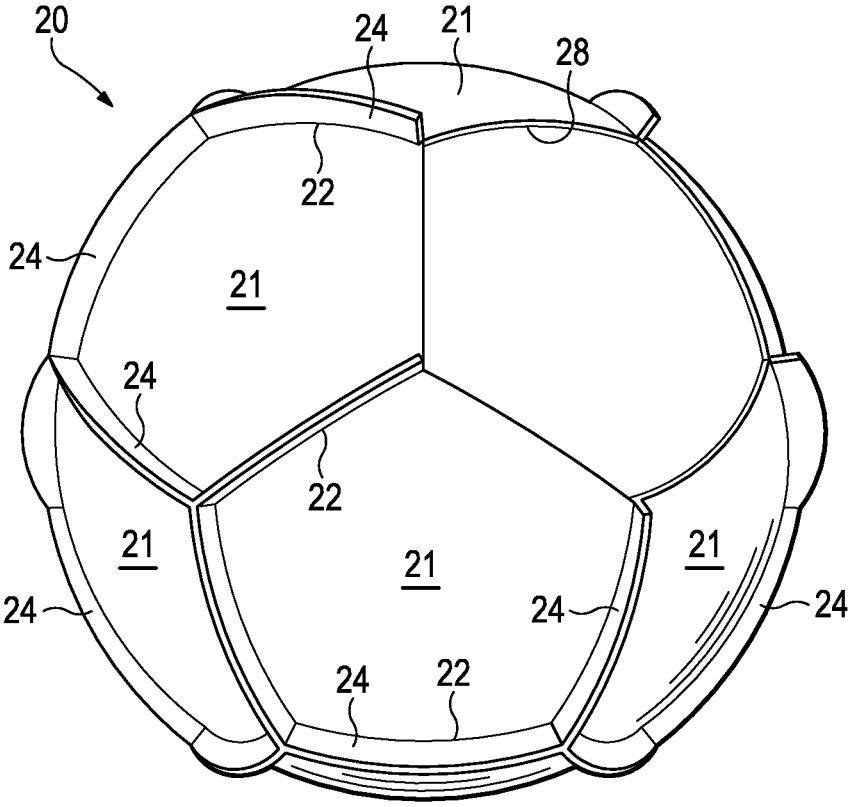
FIGS. 11A-11E are elevation views depicting further steps in the manufacturing process for a sport ball including installation of a final casing panel.

The general process of welding flange areas 24 to form seams 22 between panels 21 was generally discussed above relative to FIGS. 9A-9E. This general process may be repeatedly performed with multiple panels 21 and on multiple flange areas 24 of each panel 21 to effectively form a generally spherical or substantially closed structure, as depicted in FIG. 11A. That is, multiple panels 21 may be welded together through the general process discussed above in order to form various seams 22 in casing 20.

As shown in FIG. 11A, a method of making ball 10 may include forming a partially assembled casing 20 by joining a plurality of panels 21, leaving one open area 28 configured to receive a closure panel. As further shown in FIG. 11A, the partially assembled casing 20 may be formed inside-out, as illustrated by flange areas 24 projecting radially outward from the center of ball 10.

Figure 11B:
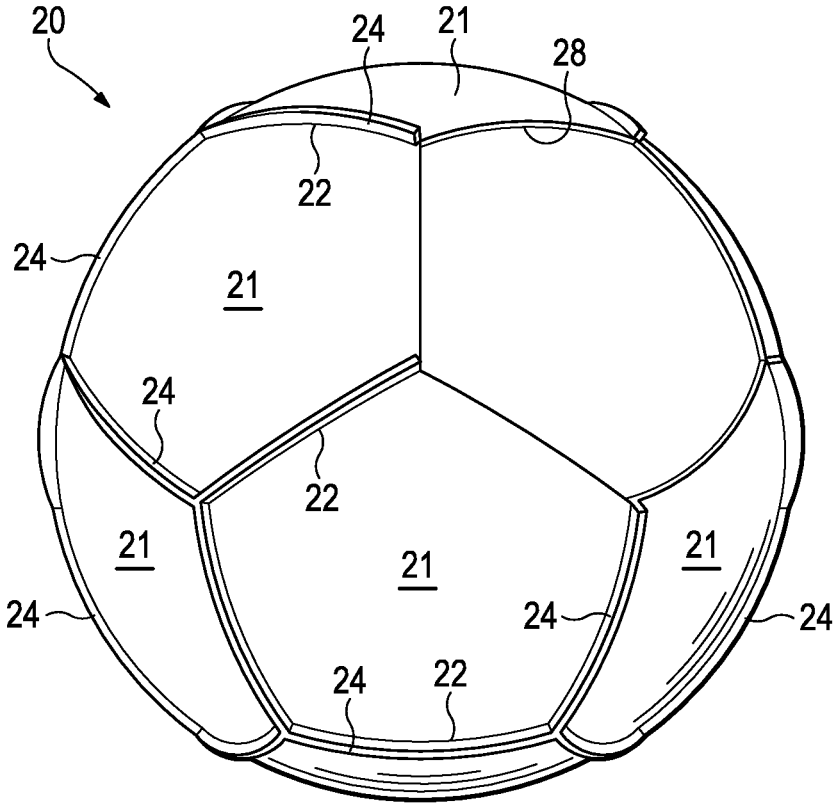

FIG. 11B depicts a similar configuration, wherein flange areas 24 have been trimmed. As discussed above, the trimming or removal of flange areas 24 may occur following the stitching or welding process or may occur at the time of the stitching or welding process.

Figure 11C:
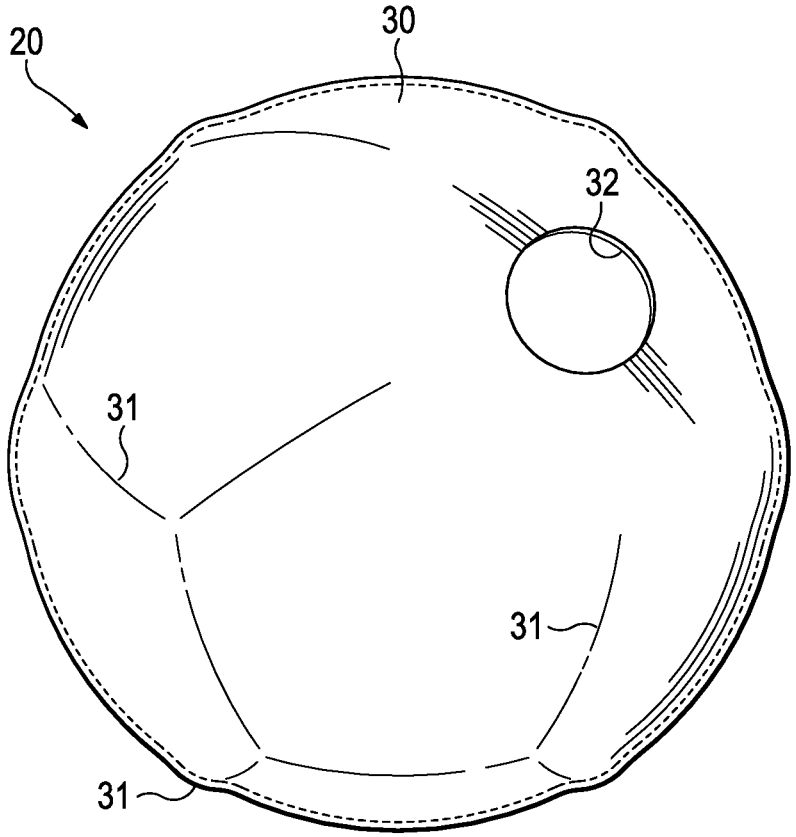

FIG. 11C illustrates an intermediate or backing layer 30 having been placed over at least a portion of the inside-out, partially assembled casing. In this configuration, flange areas 24 may create bulges 31 in backing layer 30. When the assembly is turned right-side-out, these bulges will project inward. As further illustrated in FIG. 11C, the assembly method may also include locating an opening 32 in backing layer 30 over open area 28 of the partially assembled casing 20.

Figure 11D:
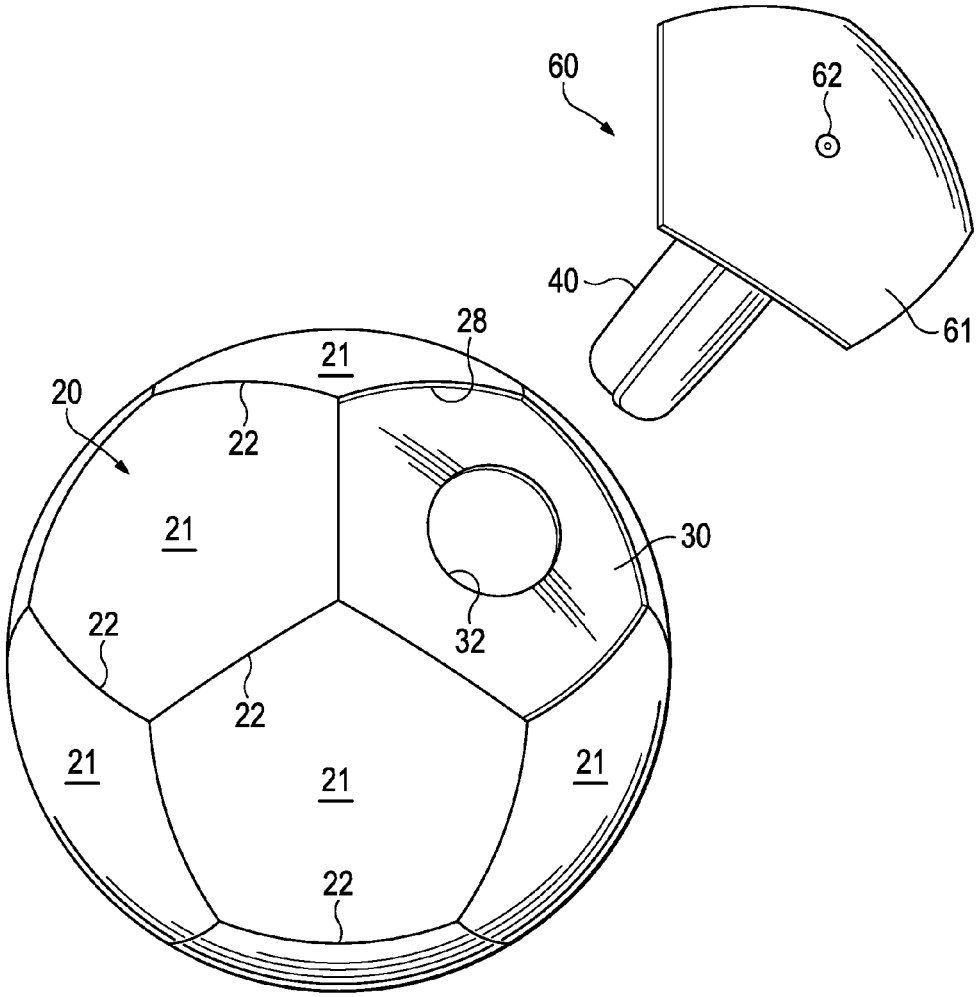

Following placement of backing layer 30, casing 20 may be reversed or turned right-side-out through opening 32 and open area 28 to impart the configuration depicted in FIG. 11D. Whereas the trimmed portions of flange areas 24 protrude outward in FIG. 11B, reversing or turning casing 20 right-side-out through opening 32 places all of flange areas 24 within casing 20. Accordingly, the trimmed flange areas 24 protrude inward, rather than outward, once casing 20 is reversed or turned right-side-out. Referring to FIG. 3, for example, an exterior of casing 20 has a generally smooth configuration, while portions of casing 20 corresponding with flange areas 24 protrude inward. Panels 21 may form indentations on the exterior of sport ball 10 in the areas of seams 22.

As shown in FIG. 11D, opening 32 in backing layer 30 may be smaller than open area 28 of the partially assembled casing 20. Once the assembly of casing 20 and backing layer 30 is in the configuration shown in FIG. 11D, a closure assembly 60 may be installed. Closure assembly 60 may include a closure panel 61, which may have substantially the same configuration as the rest of panels 21 that make up casing 20. For example, closure panel 61 and panels 21 may have the same or substantially the same layered structure. Closure assembly 60 may also include bladder 40, which may be attached to closure panel 61 and inserted through opening 32. As illustrated in FIG. 11D, bladder may also include a valve 62 for introducing fluid to bladder 40. In some configurations, valve 62 may extend through closure panel 61.

As can be seen from the view shown in FIG. 11D, backing layer 30 provides a surface upon which closure panel 61 may be mounted in open area 28, while still providing an opening 32 through which casing 20 may be turned right-side-out. When serving as a backing layer 30, the intermediate layer may have the same or similar composition as described above. For example, in some configurations, backing layer 30 may have a limited amount of stretch. This may retain the spherical shape of the ball, and may also provide a sturdy surface on which a closure panel may be mounted.

To install closure assembly 60, bladder 40 may be inserted through opening 32, and closure panel 61 may be attached to ball 10 in any suitable manner. For example, in some configurations, installing closure panel 61 may include attaching closure panel 61 to backing layer 30 with adhesive. In some configurations, installing closure panel 61 may attaching closure panel 61 to panels 21 adjacent to closure panel 61 by welding.

Figure 11E:
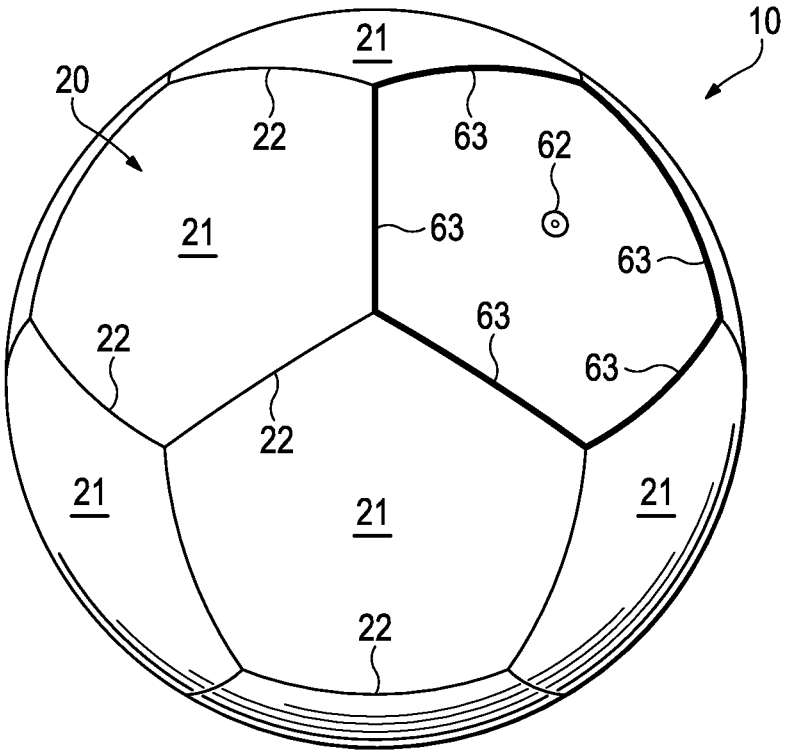

FIG. 11E illustrates ball 10 with closure assembly 60, including closure panel 61 installed. As part of the closure process, closure seams 63 may be formed, for example, as welds.

Exemplary Closure Assembly Configurations

Figure 12A:
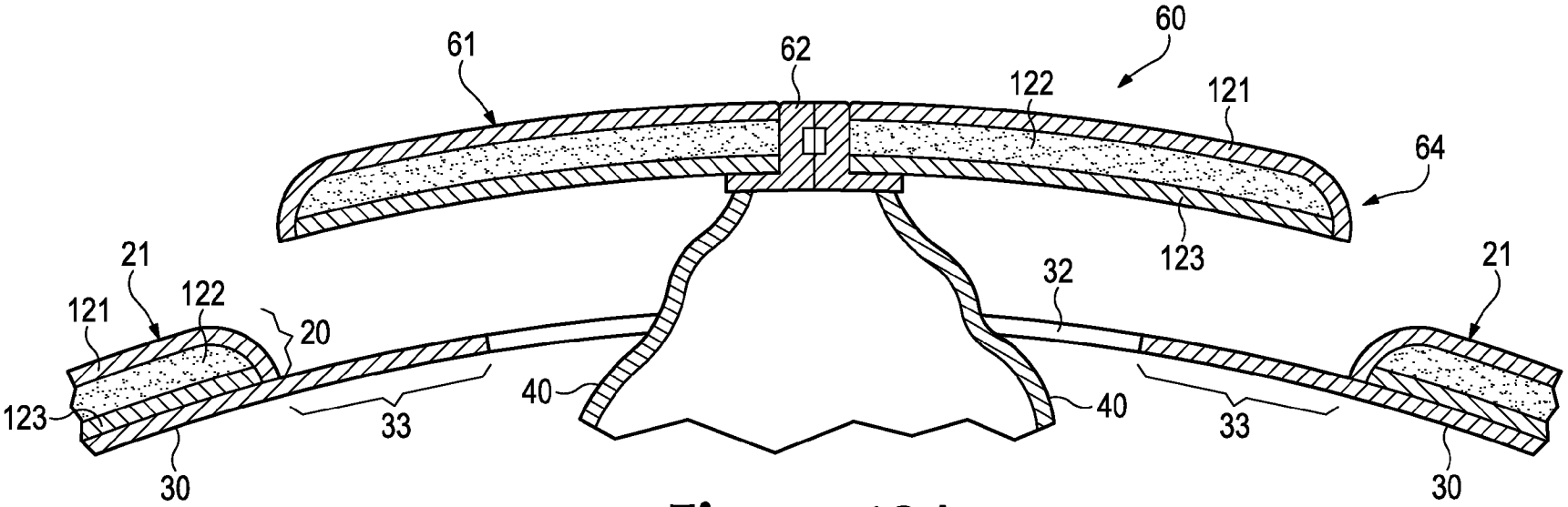
FIGS. 12A-12F are cross-sectional views of exemplary configurations of final casing panels for a sport ball.

FIG. 12A is an enlarged cross-sectional view of closure assembly 60 as it is being installed in ball 10. As shown in FIG. 12A, backing layer 30 may be located radially inward of closure panel 61. Backing layer 30 may extend beyond a peripheral boundary of closure panel 61 and may least partially overlap with one or more panels 21 adjacent to closure panel 61. Further, backing layer 30 may include opening 32, which may be located radially inward of closure panel 61. As shown in FIG. 12A, opening 32 may be smaller than the surface area of closure panel 61, thus providing a backing portion 33 upon which closure panel 61 may be mounted.

In some configurations, the peripheral edges of closure panel 61 may be rounded slightly, as shown in FIG. 12A. This rounded configuration may provide the appearance of a seam when closure panel 61 is installed. For example, even if closure panel 61 is installed using adhesive, the resulting boundary between closure panel 61 and adjacent panels 21 will appear similar to the seams 22 between panels 21, which may be formed by welding and/or stitching.

In some configurations, casing 20 may include multiple layers. For example, as shown in FIG. 12A, casing 20 may include an outer layer 121, a middle layer 122, and an inner layer 123. In some configurations, inner layer 123 may be separate from backing layer 130, as shown in FIG. 12A.

As also shown in FIG. 12A, bladder 40 may be inserted through opening 32 during the installation of closure assembly 60. Further, bladder 40 may include valve 62, which extends through opening 32 and through casing 20 of closure panel 61. Once fully installed, bladder 40 may be located radially inward of backing layer 30.

In some configurations, backing layer 30 may line the entire inner surface of casing 20 except for the area where opening 32 is located. Although truncated for purposes of illustration, FIG. 12A shows this configuration where backing layer 30 is a substantially complete lining of casing 20.

Figure 12B:
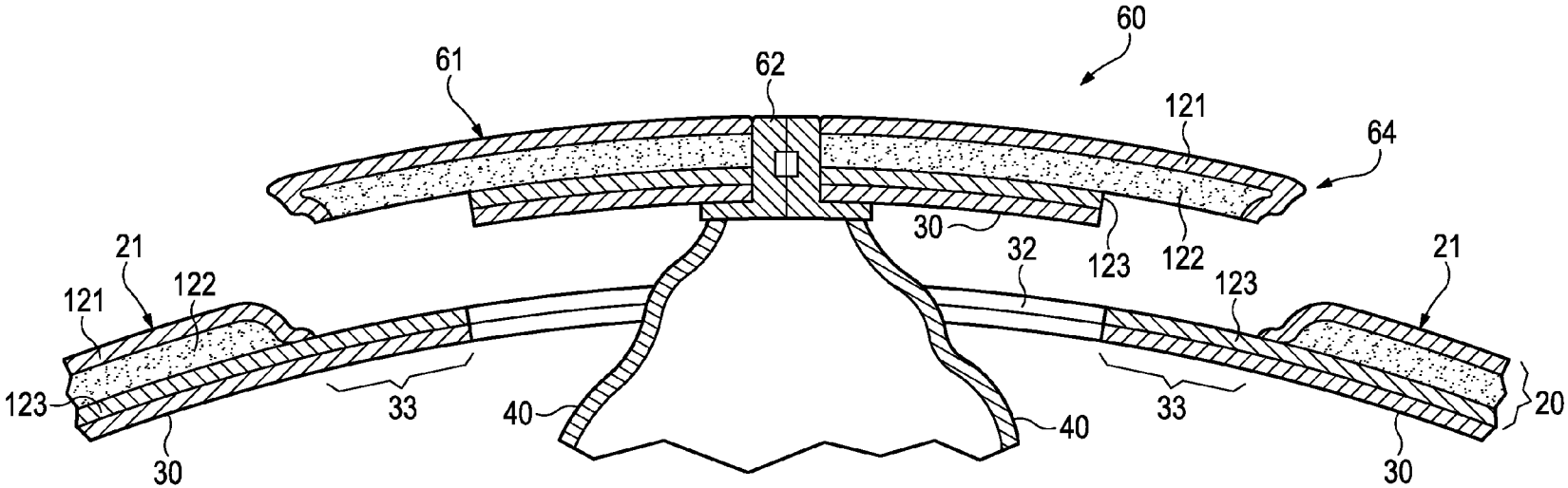

FIG. 12B illustrates an alternative configuration of closure assembly 60. As shown in FIG. 12B, in some configurations, inner layer 123 of casing 20 may extend to form backing portion 33. In some configurations, inner layer 123 may serve as the backing layer by itself. In other configurations, inner layer 123 may be accompanied by an additional backing layer 30, which may serve as an intermediate layer between bladder 40 and casing 20, as shown in FIG. 12B.

As also shown in FIG. 12B, peripheral portions 64 of closure panel 61 may have any of various shaped configurations. Not only may peripheral portions 64 be tapered, in order to provide the appearance of a seam, as discussed above, but also, peripheral portions 64 may be configured to mate with edge portions of adjacent panels 21. For example, in some configurations, peripheral portions 64 may overlap with edge portions of panels 21. Such a configuration may facilitate a welding closure process. Further, such a configuration may also provide for a more sealed seam for both welded and stitched closures.

As further shown in FIG. 12B, in some configurations, a piece of material may be attached to the inside of closure panel 61 that is the same material as backing layer 30. Such a piece of material may have a size and shape configured to substantially fill opening 32 in backing layer 30.

Figure 12C:
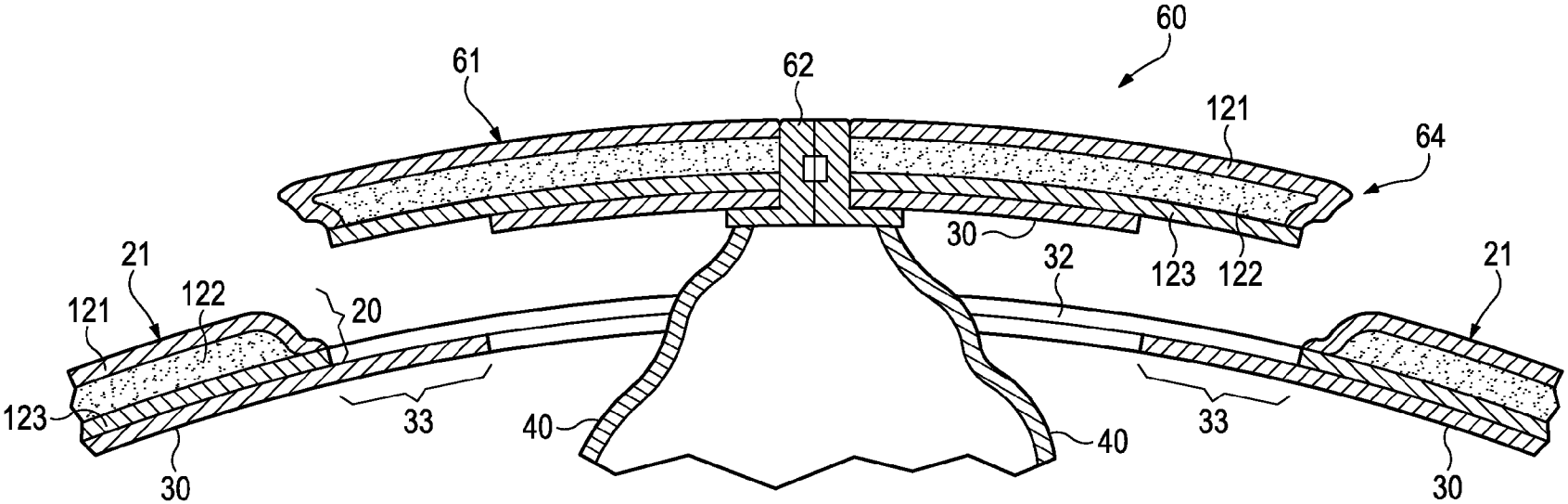

FIG. 12C illustrates another configuration. For example, as shown in FIG. 12C, in some configurations, backing portion 33 may be provided only by backing layer 30, and peripheral portions 64 of closure panel 61 may be shaped, for example in an overlapping manner with adjacent panels 21.

Figure 12D:
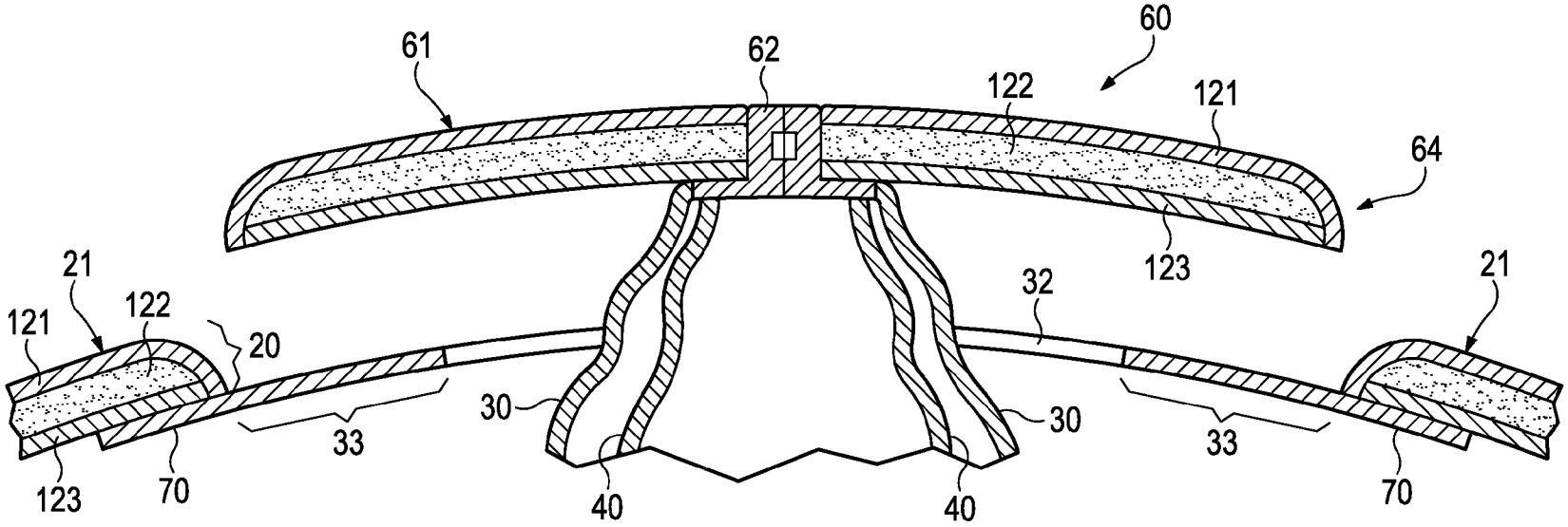

FIG. 12D illustrates yet another configuration. As shown in FIG. 12D, in some configurations, both bladder 40 and an intermediate layer 30 may be attached to closure panel 61. In addition, as further shown in FIG. 12D, a backing patch 70 may be included to provide backing portion 33 for attachment of closure panel 61. Thus, in this configuration, backing patch 70 serves as the backing layer and may extend over only a portion of the inner surface of casing 20. An advantage of this configuration is that backing patch 70 may be joined to the inner surface of casing 20 after turning casing right-side-out through open area 28.

Figure 12E:
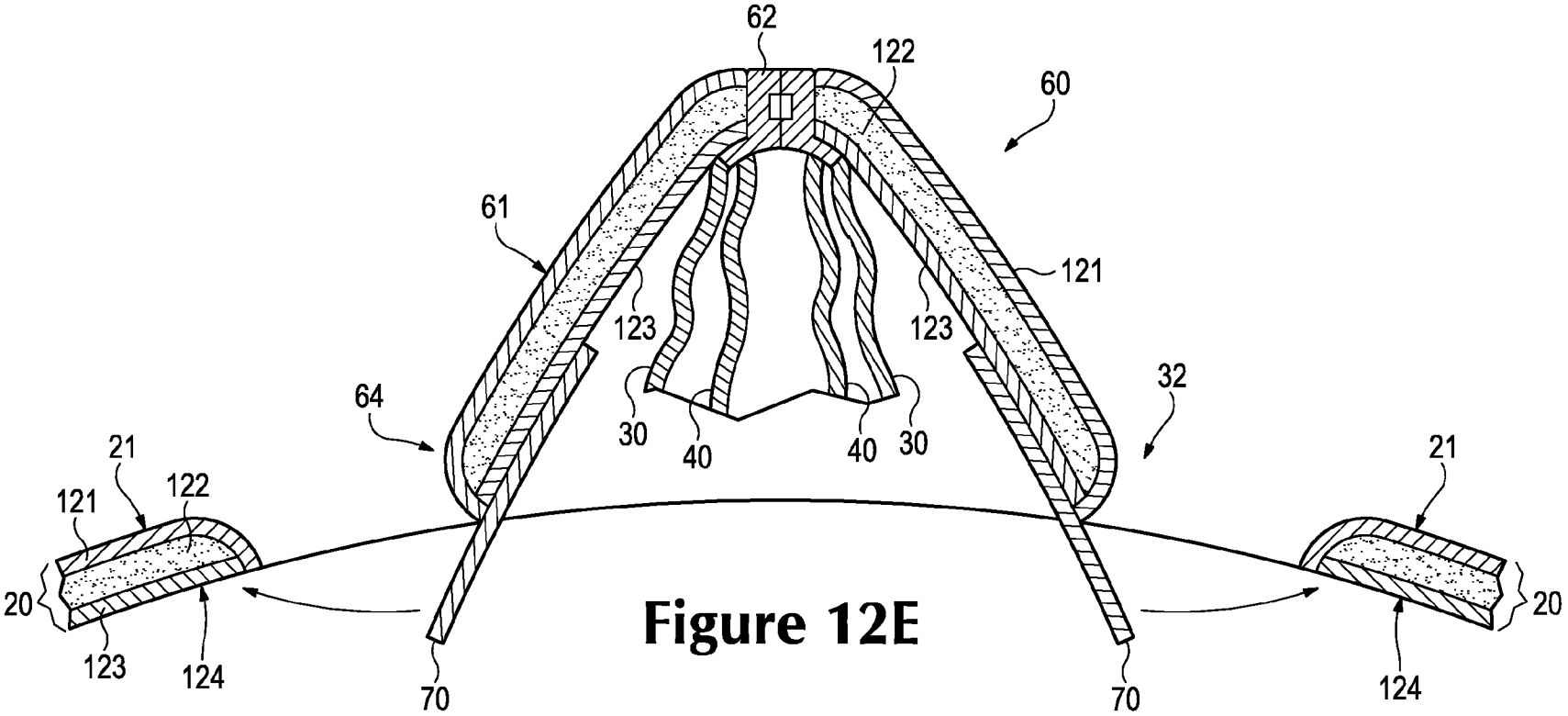
Figure 12F:
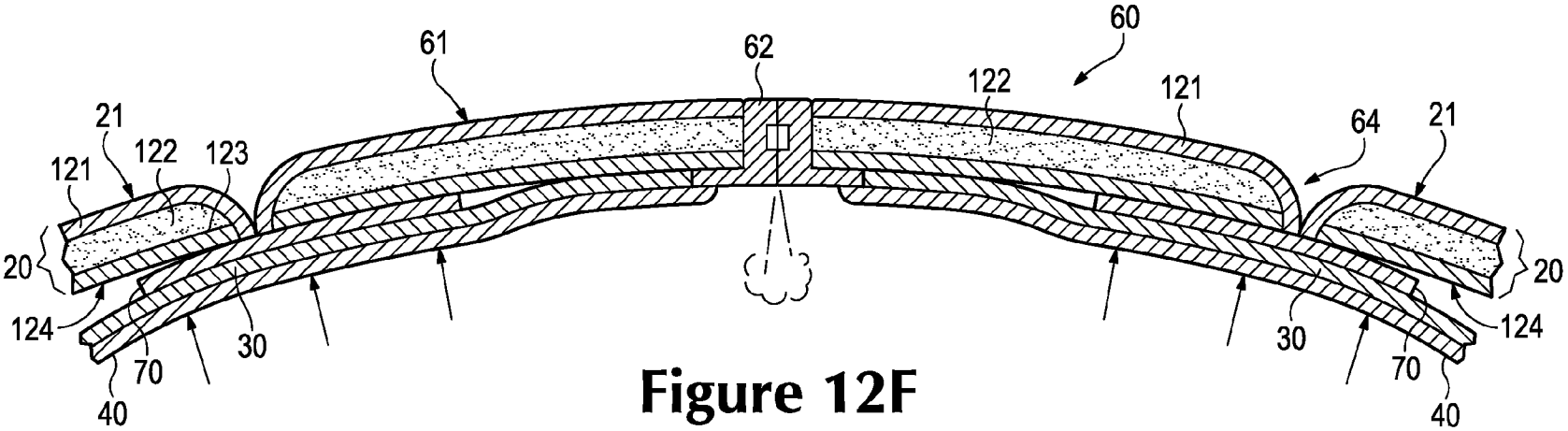

FIGS. 12E and 12F illustrates another ball configuration including backing patch 70. As shown in FIGS. 12E and 12F, in some configurations, backing patch 70 may be affixed to closure panel 61 to form closure assembly 60. Subsequently, packing patch 70 may be attached to inner surface 124 of inner layer 123 of casing 20. Closure panel 61 may be folded slightly in order to insert the extending portions of backing patch 70 into opening 32. The extending portions of backing patch 70 may be pressed against inner surface 124 of inner layer 123 of casing 20, for example, by inflating bladder 40, thereby pressing backing layer 30 radially outward, as indicated by arrows in FIG. 12F. Backing patch 70 may be secured to closure panel 61 and casing 20 by any suitable mechanism, such as adhesive.

Figure 13A:
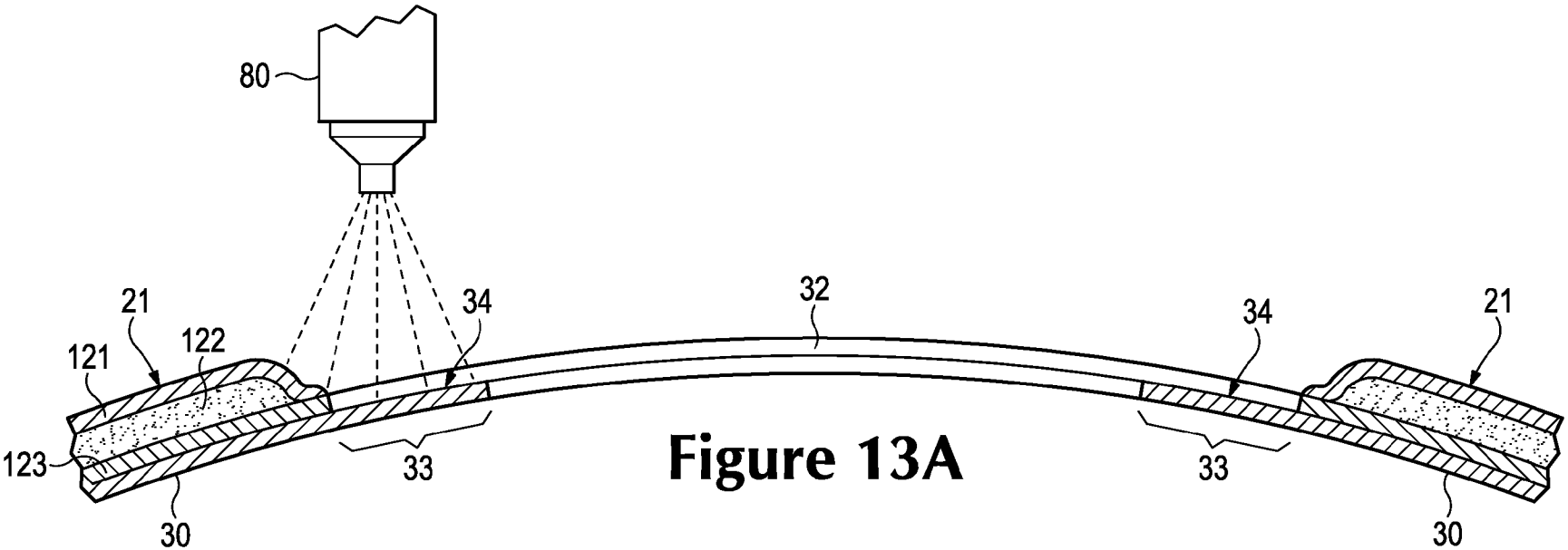
FIGS. 13A and 13B are cross-sectional views of the panels illustrating aspects of the process of installing the panels on a sport ball.

As shown in FIG. 13A, in some configurations, closure panel 61 may be attached to backing layer 30 with adhesive. FIG. 13A illustrates an adhesive applicator 80, applying adhesive to a backing surface 34 in backing portion 33 of backing layer 30.

Figure 13B:
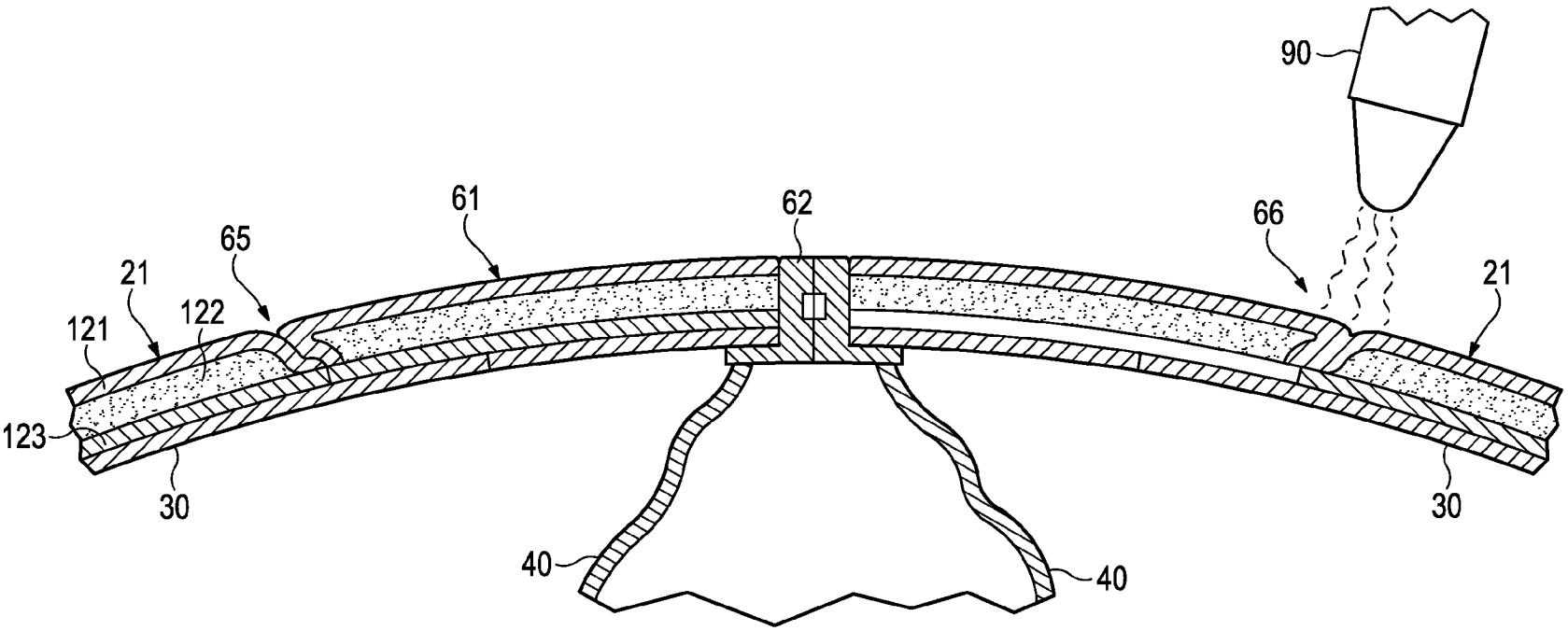

As an alternative, or in addition to, adhesive, welding may be used to install closure panel 61. FIG. 13B illustrates an installed closure assembly 61. To the left in FIG. 13B, an adhesively bound joint 65 is depicted. To the right in FIG. 13B, a welded joint 66 is depicted. As further shown in FIG. 13B, a sealing die 90 may be used to create the weld in order to form welded joint 66.

The invention is disclosed above and in the accompanying figures with reference to a variety of configurations. The purpose served by the disclosure, however, is to provide an example of the various features and concepts related to the invention, not to limit the scope of the invention. Further, any of the features of any of the disclosed configurations may be used with any other disclosed configurations. One skilled in the relevant art will recognize that numerous variations and modifications may be made to the configurations described above without departing from the scope of the present invention, as defined by the appended claims.

The invention claimed is:

1. A method of making a sport ball, comprising:

forming a partially assembled casing by joining a plurality of panels, leaving open one area configured to receive a closure panel, wherein the partially assembled casing is formed inside-out;

placing a backing layer over at least a portion of the inside-out, partially assembled casing, locating an opening in the backing layer over the open area of the partially assembled casing configured to receive the closure panel, the opening in the backing layer being smaller than the open area of the partially assembled casing;

turning the partially assembled casing and backing layer right-side-out through the opening in the backing layer and the open area of the partially assembled casing; and installing the closure panel in the open area against the backing layer.

2. The method of claim 1, wherein said installing the closure panel includes attaching the closure panel to the backing layer with adhesive.

3. The method of claim 1, wherein said installing the closure panel includes attaching the closure panel to panels adjacent to the closure panel by welding.

4. The method of claim 1, further including inserting a bladder into the partially assembled casing through the opening in the backing layer.

5. The method of claim 4, wherein the bladder is attached to the closure panel.

6. The method of claim 5, wherein the bladder includes a valve for introducing fluid to the bladder, the valve extending through the closure panel.

7. A method of making a sport ball, comprising:

forming a partially assembled casing by joining a plurality of panels, the partially assembled casing including an open area;

securing a backing layer to an interior surface of the partially assembled casing, the backing layer including an opening located within the open area, wherein the opening in the backing layer is smaller than the open area of the partially assembled casing;

positioning a bladder within the partially assembled casing by inserting the entire bladder through the opening of the backing layer;

locating a closure panel in the open area; and securing the closure panel to the backing layer.

8. The method of claim 7, wherein the backing layer includes a backing patch that partially covers the interior surface of the partially assembled casing.

9. The method of claim 8, wherein the partially assembled casing is formed inside-out, and further including turning the partially assembled casing right-side-out.

10. The method of claim 9, wherein securing the backing patch to the interior surface of the partially assembled casing is performed after the partially assembled casing is turned right-side-out.

11. A method of making a sport ball, comprising:

forming a partially assembled casing by joining a plurality of panels to one another, the partially assembled casing including an open area;

securing a backing layer to an interior surface of the partially assembled casing, the backing layer including an opening located within the open area, wherein the opening in the backing layer is smaller than the open area of the partially assembled casing;

positioning a bladder within the partially assembled casing through the opening of the backing layer;

attaching a piece of material to the inside of a closure panel, the piece of material being formed of the same material as the backing layer;

locating the closure panel in the open area such that the piece of material is disposed within the opening in the backing layer and the piece of material attached to the inside of the closure panel is in contact with the bladder; and securing the closure panel to the backing layer.

12. The method of claim 11, wherein the bladder includes a valve for introducing fluid into the ball, the method further including extending a portion of the valve through the opening in the backing layer and through the closure panel;

wherein the opening in the backing layer is larger than the portion of the valve that is extended through the opening.

13. The method of claim 11, wherein the casing includes a first area corresponding to a location of the opening in the backing layer and a second area corresponding with a remainder of the inner surface of the ball.

14. The method of claim 13, wherein the backing layer lines less than the entire second area of the inner surface of the casing.

15. The method of claim 13, wherein the backing layer lines the entire second area of the inner surface of the casing.

16. The method of claim 11, wherein the backing layer is a continuous layer of material; and wherein the backing layer is discontinuous about the entire periphery of the opening.

17. The method of claim 11, wherein, upon assembly of the ball, a majority of the piece of material attached to the inside of the closure panel is unattached to the bladder.

18. The method of claim 11, wherein the piece of material attached to the inside of the closure panel has a size and shape configured to fill the opening in the backing layer.

19. The method of claim 11, further including attaching the closure panel to panels adjacent to the closure panel by one or more welds.

20. The method of claim 19, wherein joining the plurality of panels to one another includes welding edges of the plurality of panels to one another.

* * * * *